US006025568A

United States Patent [19]

Schaeffeler et al.

[11] Patent Number: 6,025,568

[45] Date of Patent: Feb. 15, 2000

[54] ELECTRIC SWITCH

[75] Inventors: Alois Schaeffeler, Spaichingen; Jens Mueller, Tuttlingen, both of Germany

[73] Assignee: Marquardt GmbH, Rietheim-Weilheim, Germany

[21] Appl. No.: 09/095,657

[22] Filed: Jun. 11, 1998

[30] Foreign Application Priority Data

Jun. 21, 1997 [DE] Germany ..... 197 26 402

[51] Int. Cl.[7] ..... H01H 33/02; H01H 33/08; H01H 9/30

[52] U.S. Cl. ..... 218/147; 335/201; 218/123; 218/30

[58] Field of Search ..... 335/202, 201; 218/30, 32, 89, 92, 107, 108, 117, 123, 136, 146, 147, 149, 154, 155, 156

[56] References Cited

U.S. PATENT DOCUMENTS

| | | | |
|---|---|---|---|
| 1,898,128 | 2/1933 | Jackson et al. | 218/117 |
| 2,458,804 | 1/1949 | Sundt | 218/155 |
| 2,753,413 | 7/1956 | Anderson | 218/154 |
| 4,594,489 | 6/1986 | Gengenbach et al. | 200/151 |
| 4,659,887 | 4/1987 | Belbel et al. | 218/155 |

FOREIGN PATENT DOCUMENTS

| | | |
|---|---|---|
| 0350828 | 1/1990 | European Pat. Off. . |
| 4232975 | 5/1993 | Germany . |
| 4234065 | 12/1993 | Germany . |

*Primary Examiner*—Lincoln Donovan
*Attorney, Agent, or Firm*—Venable; George H. Spencer; Catherine M. Voorhees

[57] ABSTRACT

An electric switch (1), in particular for electric hand tools having an electric motor operated by means of direct current. The switch (1) possesses a contact system (9) consisting of a fixed contact (10) and of a switching contact (11), an actuating member (3) for triggering a switching operation between an "off" and an "on" position of the contact system (9) acting on the switching contact (11). The contact system (9) is assigned means (18), consisting of a shield (19), for extinguishing an arc generated between the fixed contact (10) and the switching contact (11) during the switching operation. The shield (19) can be moved together with the switching contact (11) in a coupled manner, during the operation to switch the switching contact (11) from the "on" to the "off" position the shield (19) being moved into the region located between the fixed and switching contacts (10, 11). Conversely, during the operation to switch the switching contact (11) from the "off" to the "on" position, the shield (19) is moved out of the region located between the fixed and switching contacts (10, 11), so that the switching contact (11) can be laid onto the fixed contact (10).

7 Claims, 6 Drawing Sheets

ELECTRIC SWITCH

BACKGROUND OF THE INVENTION

The invention relates to an electric switch operated by means of direct current comprising a contact system which includes a fixed contact and a switching contact, and an actuating member acting on the switching contact in order to trigger a switching operation between an "off"and an "on"position of the contact system where the contact system is assigned means for extinguishing an arc generated between the fixed contact and the switching contact during the switching operation.

Electric switches of this type are used, in particular, as power switches in electric hand tools. High currents may flow, in the case of electric motors operated by means a direct voltage of, for example, 125 volts, so that, when they are switched off, an arc occurs at the contacts. The occurrence of arcs may lead to the destruction of the switch, which must be prevented in the case of electric tools for safety reasons.

DE-A1-4232975 discloses an electric switch for high currents, which is provided with means for extinguishing an arc. This switch possesses a contact system consisting of a fixed contact and of a switching contact. An actuating member acts on the switching contact in order to trigger a switching operation between an "off" and an "on" position of the contact system. The means, assigned to the contact system, for extinguishing an arc generated between the fixed contact and the switching contact during the switching operation consist of an extension in the manner of an extinguishing lug on the fixed contact. During the changeover from the "on" to the "off" position, an arc which may possibly occur is dragged onto the extinguishing lug by the moving switching contact. After a particular distance between the extinguishing lug and the switching contact has been exceeded, the arc is then extinguished.

The distance which the switching contact covers during the changeover must be of some length, so that the arc can be extinguished. Additional space is required for the extinguishing lug. This switch consequently cannot be employed in some instances of use, in particular when the handles of electric tools are slender. Moreover, in the case of very high direct currents, it may happen that an arc can no longer be extinguished, thus resulting in premature destruction of the switch.

In the case of earth leakage circuit breakers, which are used, for example in house installations, means for the extinguishing of arcs are likewise known. For example, a circuit breaker with a contact system consisting of a fixed contact and of a switching contact is described in DE-C1-4234065. The switching contact is loaded by a spring in the direction of the "off" position and, in the "on" position, is held bearing on the fixed contact by a movable separating element. An actuating member acts via a toggle lever on the separating element, so that, during the changeover from the "on" to the "off" position, the separating element is moved between the switching contact, which then lifts off from the fixed contact due to the action of the spring, and the fixed contact. Any arc which is possibly generated is forced by the separating element into a spark channel and is extinguished there.

In this circuit breaker, the actuating member does not act directly on the switching contact. Instead, the separating element is mechanically coupled to the actuating member in a complicated manner and movement of the separating element ultimately leads to the changeover of the contact system. The contact system provided with the device for arc extinguishing is complicated and involves a high outlay. Due to the complicated mechanical design, it is also susceptible to faults. Moreover, the contact system requires a large amount of space. A contact system which involves such a high outlay therefore provides no pointer to a small switch which can be used in handles of electric tools and which is unsusceptible to faults.

SUMMARY OF THE INVENTION

The object on which the invention is based is to develop an electric switch, which can be used particularly in electric tools, in such a way that, despite being of small size, it is possible to use it even in the case of high currents.

This object is achieved by the switch according to the invention where the means for extinguishing the arc includes a shield which is assigned, in particular, to the fixed contact and which is coupled to the switching contact, for example by means of a rigid positive coupling or by means of a power-operated positive coupling. The movement of the switching contact during the switching operation is transmitted to the shield by means of the coupling, so that the shield is moved into or out of the region between the fixed contact and switching contact. Any arc which is possibly generated is interrupted by the electrically insulating shield and is thereby extinguished, so that the shield acts in the manner of a spark arrester.

The contact system of the electric switch, is located in a and, is preferably designed in the manner of a snap-action switching system. The switching contact is arranged on a movable switching arm which is suspended on a bearing part in a rotationally movable manner, a leaf spring being clamped between the switching arm and one lever arm of a two-armed transmission rocker. A tappet, which is moved, in turn, via an actuating member mounted rotatably on the housing, acts on the other lever arm of the transmission rocker.

In order to prevent the arc from escaping laterally, the shield may be designed in the manner of a hood which is open on the side facing the fixed contact. When the hood is moved into the region between the fixed contact and switching contact, the hood masks the fixed contact at least on the side facing the switching contact. The hood is mounted rotatably in the housing of the switch, and an approximately S-shaped movement transmission member articulated on the hood and the switching contact serves for positive coupling to the switching contact. The articulation of one side of the movement transmission member on the hood may take place by means of a rotary joint which is arranged eccentrically to a pivot pin of the hood on the housing. The other side of the movement transmission member is articulated on the switching arm by means of a ball pin engaging into a receiving part. In order to avoid tilts during the movement of the hood, it is appropriate, furthermore, to use two movement transmission members which engage over the hood in an approximately fork-like manner and which are connected to one another by means of a crossmember part at the end facing away from the hood. In this case, the ball pin is located on the crossmember part, and the receiving part possessing a catch bearing for the ball pin is slipped on an extension of the switching arm.

The arc may be prevented from escaping from the hood on the open side or downward by fastening a further immovable shielding part as an insulating part in the lateral vicinity of the fixed contact in the housing of the switch, in such a way that said shielding part faces the open side of the hood. The hood and the further shielding part thereby form a kind of closed chamber for the fixed contact. If the fixed contact is arranged at one end of a carrier part, in which case the other end of the carrier part may be provided, for example, with a screw connection for an electric feedline to the switch, the further shielding part is arranged in the region of the carrier part. The further shielding part thereby masks the carrier part on the side facing the switching contact. This masking may be further improved by designing the carrier part so as to be bent in an approximately U-shaped manner and by extending the further shielding part into the bend of the carrier part.

The advantages achieved by means of the invention are, in particular, that an arc which possibly occurs is extinguished within a short time. Burnoff of the contacts of the contact system is therefore effectively prevented and destruction of the switch by arcs consequently forestalled. The lifetime of the switch is thereby increased considerably.

The electric switch is suitable particularly for high currents and may therefore be employed in electric tools of high power. In particular, the switch can be used for electric motors operated by direct voltage, where an arc is not automatically extinguished except at the alternating voltage crossover.

In conventional switches for electric tools which are operated by direct current, a large contact opening width is usually provided in order to ensure that arcs are extinguished. In this case, however, increased contact chatter occurs during the switch-on operation, the result of this being, in turn, that the switch has a short lifetime. In the case of the switch according to the invention, the contact opening width may be kept small, so that contact chatter is effectively prevented. Moreover, the switch as a whole may be of compact and small design, so that the switch is suitable particularly for narrow ergonomic handles of electric tools.

BRIEF DESCRIPTION OF THE DRAWINGS

An exemplary embodiment of the invention, together with developments, is illustrated in the drawings and is described in more detail below. wherein.

DETAILED DESCRIPTION OF THE INVENTION

Figure 1:
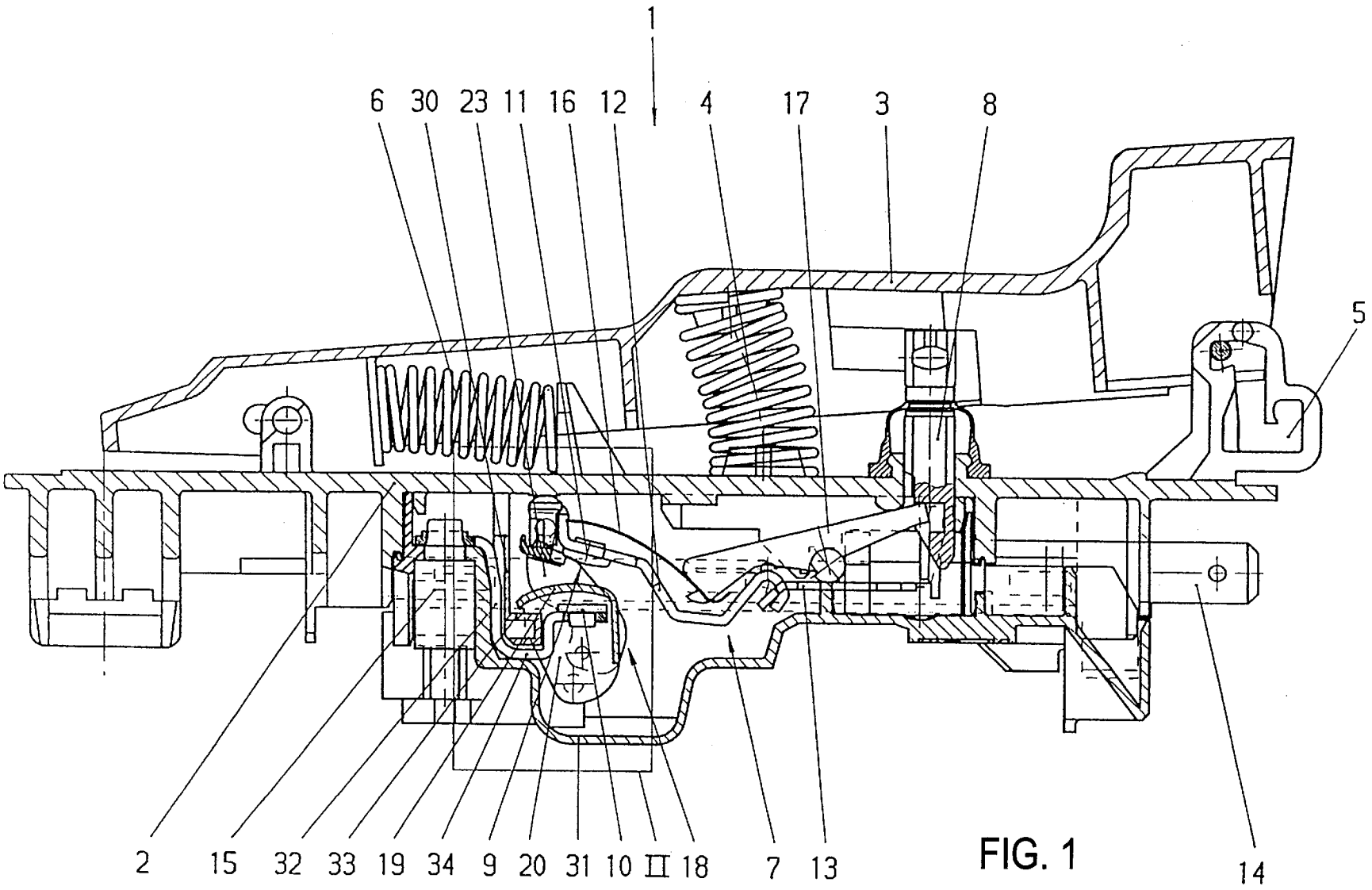
FIG. 1 shows a longitudinal section through an electric switch.
Figure 8:
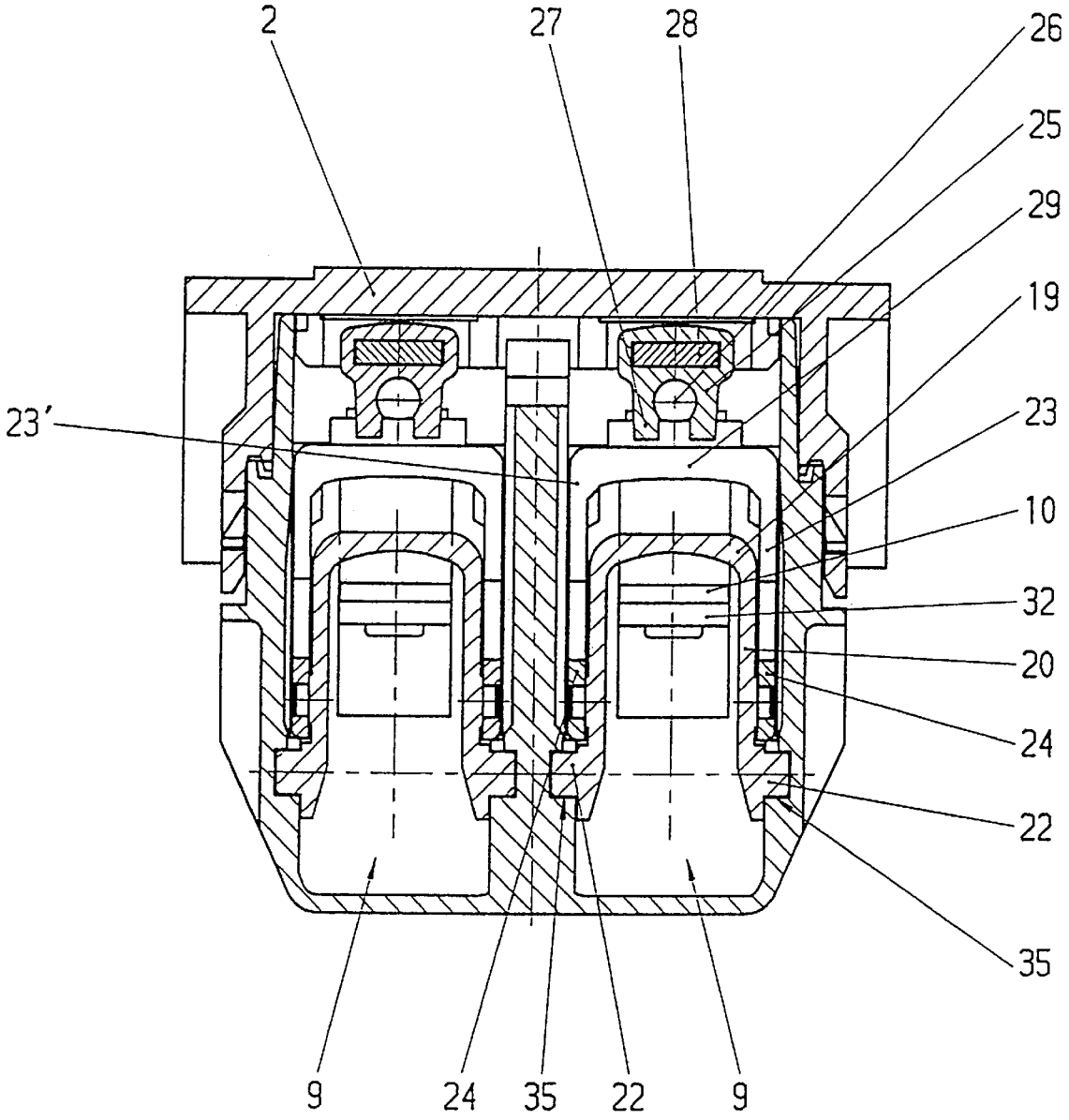
FIG. 8 shows a section along the line 8–8 of FIG. 7.

An electric switch 1 for an electric hand tool can be seen in section in FIG. 1. The switch 1 is used, for example, as a power switch in angle grinders which possess an electric motor operated by means of direct current. For use of this kind, the switch 1 is of double-pole design with two contact systems 9, as may be seen from FIG. 8.

As may be inferred in more detail from FIG. 1, the switch 1 possesses a housing 2, on which an actuating member 3 is mounted rotatably counter to the force of a compression spring 4. Also located on the housing 2 is a device 5 which, in cooperation with a further spring 6, serves as a switch-on preventer and locking means for the actuating member 3. The rotational movement of the actuating member 3 is transmitted to the contact system 9, located in the housing 2, via a linearly movable tappet 8 extending into the interior 7 of the housing 2. As a result, a switching operation between an "off" and an "on" position is triggered in the contact system 9 which consists of a fixed contact 10 and of a switching contact 11. The contact system in the "off" position, in which the switching contact 11 is removed from the fixed contact 10, can be seen in more detail in FIG. 2. The contact system in the "on" position, in which the switching contact 11 bears on the fixed contact 10, is shown in more detail in FIG. 3.

The switching contact 11 is located on a movable switching arm 12 which is suspended on a bearing part 13 in a rotationally movable manner. The bearing part 13 is electrically connected to an electric terminal 14 which projects from the housing 2 and from which, for example, a feedline to the electric motor leads further. The fixed contact 10 is arranged at one end of a carrier part 32. The other end of the carrier part 32 is provided with a further electric terminal 15 for an electric feedline, said terminal being, for example, a screw connection for the supply of power to the switch 1.

In a preferred version, the contact system 9 is designed in the manner of a snap-action switching system, a leaf spring 16 being clamped between the switching arm 12 and one lever arm of a two-armed transmission rocker 17. The tappet 8 acts on the other lever arm of the transmission rocker 17. Due to the action of the actuating member 3 on the switching arm 12 via the tappet 8, the transmission rocker 17 and the leaf spring 16, the switching contact 11 consequently changes over with a snapping action between the "off" and the "on" positions of the contact system 9.

When electric motors of high power are operated, correspondingly high currents flow via the contact system 9 of the switch 1 in the "on" position. For example, in the case of angle grinders having a power of 2.3 kilowatts, a direct current of up to approximately 120 amperes may flow. When the electric motor is switched off, that is to say when the contact system 9 is switched into the "off" position, an arc is then generated between the switching contact 11 and the fixed contact 10, and the arc may lead to contact burnoff. In order to avoid the destruction of contact system 9, the contact system 9 is assigned means 18 for extinguishing an arc generated between the fixed contact 10 and the switching contact 11 during the switching operation.

Figure 2:
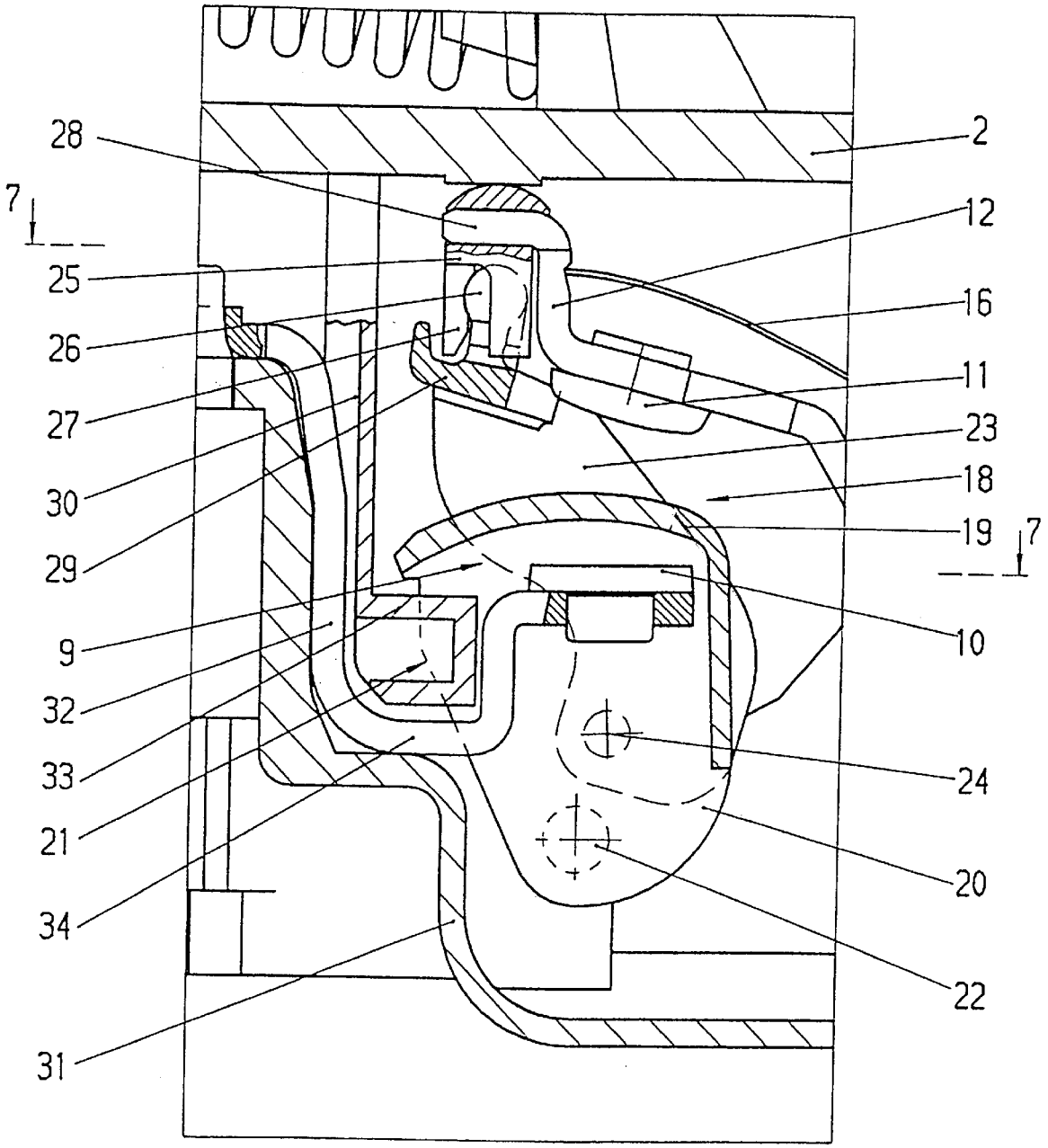
FIG. 2 shows an enlarged detail of the contact system, corresponding to the area II of FIG. 1, the contact system being in the "off" position.

As may be seen in more detail in FIG. 2, these means 18 for extinguishing the arc consist of a shield 19 which can be moved together with the switching contact 11 in a coupled, specifically, in particular, positively coupled manner. When the operation to switch the switching contact 11 from the "on" to the "off" position is triggered via the actuating member 3, then, due to this coupling the shield 19 is moved into the region located between the fixed contact 10 and the switching contact 11, as shown in FIG. 2. The shield 19 consequently moves into the arc, so that the arc is displaced or interrupted and is ultimately extinguished. During the reverse operation to switch the switching contact 11 from the "off" to the "on" position, the shield 19 is moved out of the region located between the fixed contact 10 and switching contact 11, as may be seen in FIG. 3. Since the shield 19 is then located outside this region between the fixed contact 10 and switching contact 11, in the "on" position the switching contact 11 can be laid, unimpeded, onto the fixed contact 10. If the contact system 9 is designed as a snap-action switching system, as described above, the shield 19 is moved with high acceleration, as a result of which an arc generated during the changeover from the "on" to the "off" position is interrupted in the shortest possible time.

Figure 3:
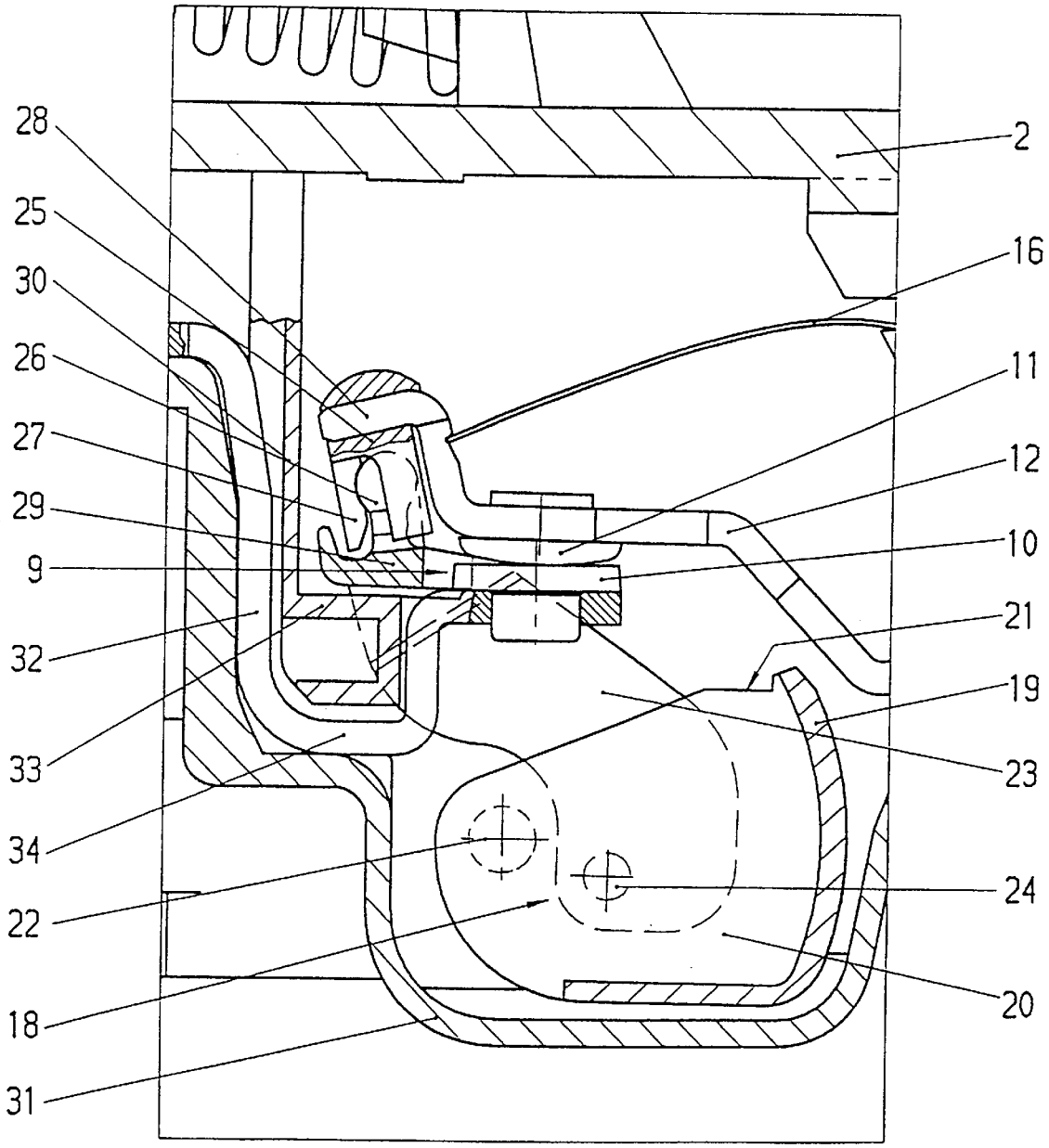
FIG. 3 shows an enlarged detail of the contact system, as in FIG. 2, the contact system being in the "on" position.

It is appropriate to arrange the shield 19 in the housing 2 in such a way that the shield is assigned essentially to the fixed contact 10, as inferred particularly from FIG. 3. The shield may, of course, also be assigned to the switching contact 11, in which case, however, the cinematics for the shield may be more complex, since the switching contact 11, in contrast to the stationary fixed contact 10, likewise constitutes a moving part. Rigid positive coupling by means of a movement transmission member 23 may be provided for the coupling between the switching contact 11 and shield 19. It is also possible, of course, for the shield 19 to be movable together with the switching contact 11 via a power-operated positive coupling, although this is not shown in any more detail.

It is expedient, furthermore, to design the shield 19 as a large-area insulating part made from electrically nonconductive material. The shield 19 thereby acts in the same way as an isolator which, during the changeover from the "on" to the "off" position, is pushed with a broadly extended surface into the space located between the fixed contact 10 and switching contact 11, the arc being interrupted. Since the arc is thereby extinguished, a shield 19 of this type forms a kind of spark arrester.

Figure 4:
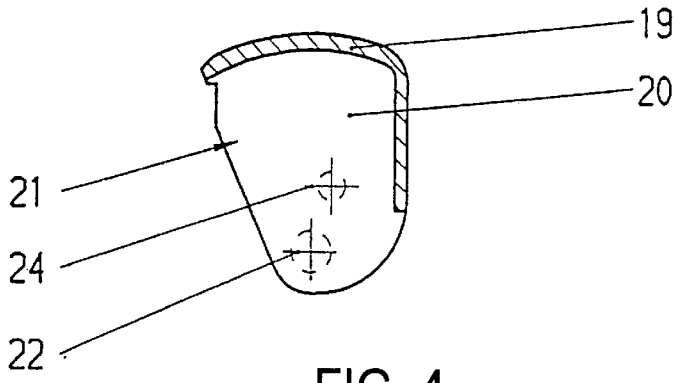
FIG. 4 shows a side view of the shield in the manner of a hood as an individual part.
Figure 5:
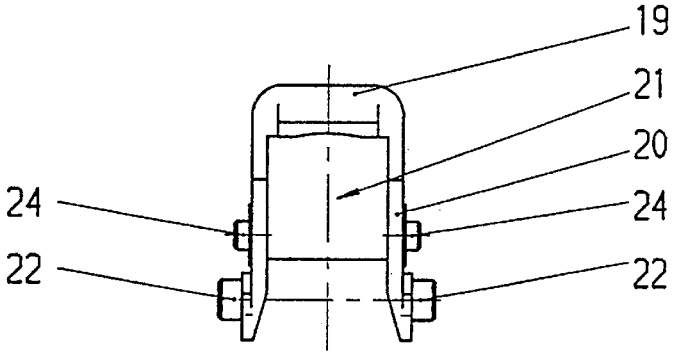
FIG. 5 shows a top view of the shield in the manner of a hood as an individual part.

It is of further advantage if, in addition, at least parts of the sides adjacent to the spark arrester are provided with insulating walls. In this case, the shield is designed in the manner of a hood 20. The hood 20 is open on one side, specifically on the side 21 facing the fixed contact 10, as may be seen particularly clearly in FIGS. 4 and 5, where the hood 20 is illustrated as an individual part. During the movement of the hood 20 into the region located between the fixed contact 10 and switching contact 11, the hood 20 then not only isolates the fixed contact 10, but masks it, at least on the side facing the switching contact 11, as seen in more detail in FIG. 2.

As already stated, the shield 19 can be moved into and out of the region located between the fixed contact 10 and switching contact 11. This is expediently a rotational movement, so that the shield 19 is mounted rotatably in the housing 2. For this purpose, the hood 20 possesses a pivot pin 22 which engages rotatably into a corresponding receptacle 35 in the housing 2, the receptacle being shown in FIG. 8. The movement transmission member 23, which is approximately S-shaped, is articulated on one side on the hood 20 and on the other side on the switching contact 11. A rotary joint 24 serves for articulation on the hood 20. The rotary joint 24 is arranged on the hood 20 eccentrically to the pivot pin 22. A ball pin 26, which engages into a receiving part 25 on the switching arm 12, serves for articulating the movement transmission member 23 on the switching contact 11 or on the switching arm 12. The receiving part 25 possesses catch arms 27, so that a catch bearing is formed for the ball pin 26. The receiving part 25 is slipped on an extension 28 of the switching arm 12.

Figure 6:
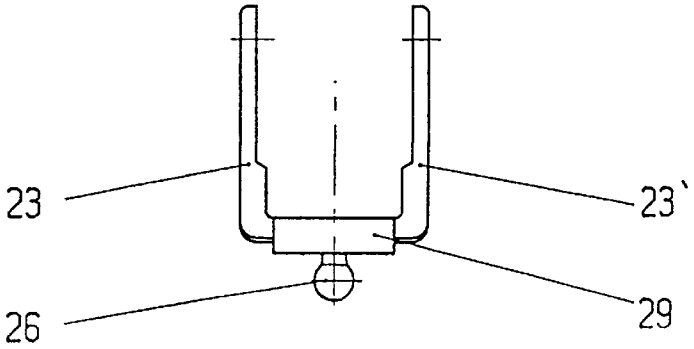
FIG. 6 shows a top view of the movement transmission member between the switching contact and the shield according to a development, as an individual part.
Figure 7:
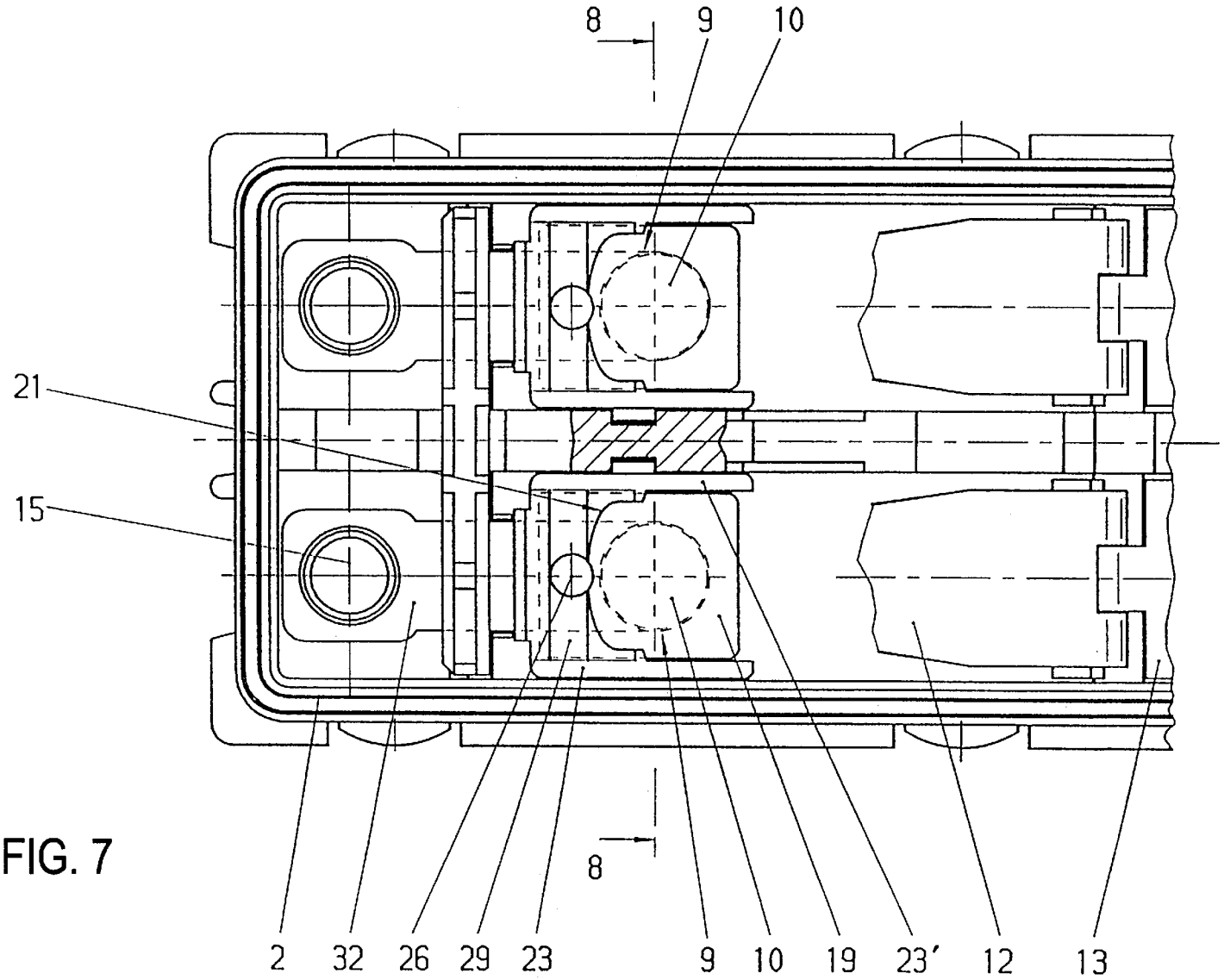
FIG. 7 shows a section along the line 7–7 of FIG. 2.

If the shield 19 is designed as a hood 20, it is appropriate, in one development, to provide two movement transmission members 23, 23' for positive coupling to the switching contact 11, as emerges in more detail, in particular, from FIG. 6. The two movement transmission members 23, 23' engage over the hood 20 in an approximately fork-like manner and are connected to one another by means of a crossmember part 29 at the end facing away from the hood 20. The ball pin 26 is located on the crossmember part 29. The assignment of the two movement transmission members 23, 23' to the hood 20 and their arrangement in the housing 2 are shown in more detail in FIGS. 7 and 8.

When currents are very high, an arc may, under some circumstances, escape on the open side 21 of the hood 20, despite the fixed contact 10 being masked by the latter. In order to prevent this, in one development a further shielding part 30 is arranged as an insulating part made of electrically nonconductive material in the lateral vicinity of the fixed contact 10, as seen from FIG. 2. The further shielding part 30 faces the open side 21 of the hood 20 and is fastened in the housing 2, as a result of which it is immovable, in contrast to the hood 20. In this case, the further shielding part 30 is arranged in the region of the carrier part 32, in such a way that the carrier part 32 is essentially masked on the side facing the switching contact 11.

This refinement may be improved even further by giving the carrier part 32 a bent design, specifically so as to be bent in an approximately U-shaped manner. The further shield part 30 extends into the bend 34 of the carrier part 32 and possesses a lengthening piece 33 covering the bend 34. When the hood 20 masks the fixed contact 10 in the "off" position of the contact system 9, the hood 20 and the further shielding part 30, together with the lengthening piece 33, form a kind of chamber for the fixed contact 10, said chamber being essentially closed in the direction of the switching contact 11. It is consequently impossible for the arc to escape laterally, in particular in the direction of the further shielding part 30 and of the lengthening piece 33. An arc could now escape from this chamber at most downward, that is to say in the direction of the lower wall 31 of the housing 2, but in that case the arc would likewise be interrupted and extinguished.

The invention is not restricted to the exemplary embodiment described and illustrated. On the contrary, it also embraces all developments within the scope of the inventive idea which are open to the average person skilled in the art. Thus, the invention may be used not only on switches for electric tools, but also on switches for control equipment, for example in the automobile sector or the like.

We claim:

1. An electric switch for use in hand-held tools that are operated with a direct current, said switch comprising:

a contact system including a fixed contact and a movable contact;

an actuating member which acts upon the movable contact and triggers a switching operation when the contact system is switched between an ON and an OFF position;

means for extinguishing an arc which occurs between the fixed contact and the movable contact during a switching operation, said extinguishing means includes a shield; and a movement transmission member connected to the movable contact and to the shield thereby linking or coupling the shield to the movable contact so that movement of the shield corresponds to the movement of the movable contact and the shield is forced to move with the movable contact, and during the switching operation of the movable contact from the ON to the OFF position, the shield is moved into the region between the fixed contact and the movable contact as a result of the forced coupling and, during the switching operation of the movable contact from the OFF to the ON position, the shield is moved from the region between the fixed contact and the movable contact, due to the forced coupling, so that the movable contact in the ON position rests against the fixed contact.

2. The electric switch according to claim 1 wherein the contact system is located in a housing, the actuating member is mounted pivotally on the housing and acts on the contact system via a tappet which extends into the interior of the housing and which can be moved linearly into the housing, and the contact system is designed in the manner of a snap-action switching system, the switching contact being arranged on a movable switching arm which is suspended on a bearing part in a rotationally movable manner, a leaf spring being clamped between the switching arm and one lever arm of a two-armed transmission rocker, the tappet acting on the other lever arm of the transmission rocker.

3. The electric switch according to claim 1, wherein the shield is assigned to the fixed contact the shield and is movable together with the switching contact in a positively coupled manner, in particular by rigid or power-operated positive coupling, and the shield is designed as an insulating part in the manner of a spark arrester made of electrically nonconductive material.

4. An electric switch for electric hand tools having an electric motor operated by means of direct current, with a contact system which includes a fixed contact, a switching contact, and an actuating member acting on the switching contact in order to trigger a switching operation between an "off" and an "on" position of the contact system, the contact system being assigned means for extinguishing an arc generated between the fixed contact and the switching contact during the switching operation, wherein the extinguishing means includes a shield that can be moved together with the switching contact in a coupled manner, during the operation to switch the switching contact, and during the operation to switch the switching contact from the "off" to the "on" position the shield is moved out of the region located between the fixed and switching contacts, so that the switching contact can be laid onto the fixed contact, and wherein the shield is designed in the manner of a hood which is open on one side so that, during the movement of the hood into the region located between the fixed and switching contacts, the fixed contact is masked at least on the side facing the switching contact, the hood is mounted rotatably in the housing by means of pivot pins, and a movement transmission member is articulated on the hood and the switching contact, and said electric switch further comprises a rotary joint articulating one side of the movement transmission member on the hood and being arranged eccentrically to the pivot pin, and a ball pin engaging into a receiving part for articulating the other side of the movement transmission member on the switching arm.

5. The electric switch according to claim 4, wherein the movement transmission member is of an approximately S-shaped design, and two movement transmission members engage over the hood in an approximately fork-like manner and the electric switch further comprises a crossmember part that connects the two movement transmission members to one another at the end facing away from the hood, the ball pin being arranged on the crossmember part, and the receiving part possessing a catch bearing for the ball pin slipped on an extension of the switching arm.

6. The electric switch according to claim 5, further comprising an immovable shielding part, which is arranged in the lateral vicinity of the fixed contact so as to face the open side of the hood, said immovable shielding part being an insulating part made of electrically nonconductive material that is fastened in the housing in such a way that the hood and the shielding part form a kind of chamber for the fixed contact, said chamber being essentially closed in a direction of the moving contact, thus preventing the arc from escaping laterally.

7. The electric switch according to claim 5, wherein the fixed contact is arranged on one end of a carrier part, and the other end of the carrier part is provided with a screw connection for an electric feedline to the switch, the shielding part being arranged in the region of the carrier part so as essentially to mask the carrier part on the side facing the movable contact, and the carrier part is bent and has an approximately U-shaped bend, the shielding part extending with a lengthening piece into the U-shaped bend of the carrier part.

* * * * *